US008351823B2

(12) United States Patent
Nohsho et al.

(10) Patent No.: US 8,351,823 B2
(45) Date of Patent: Jan. 8, 2013

(54) IMAGE FORMING APPARATUS, IMAGE BEARING MEMBER, AND METHOD OF MANUFACTURING IMAGE BEARING MEMBER

(75) Inventors: Shinji Nohsho, Numazu (JP); Mayumi Yoshihara, Numazu (JP); Mihoko Matsumoto, Susono (JP); Yukio Fujiwara, Numazu (JP); Kohsuke Yamamoto, Zama (JP)

(73) Assignee: Ricoh Company, Ltd, Tokyo (JP)

( * ) Notice: Subject to any disclaimer, the term of this patent is extended or adjusted under 35 U.S.C. 154(b) by 267 days.

(21) Appl. No.: 12/825,986

(22) Filed: Jun. 29, 2010

(65) Prior Publication Data

US 2010/0329741 A1 Dec. 30, 2010

(30) Foreign Application Priority Data

Jun. 30, 2009 (JP) ..... 2009-154791

(51) Int. Cl.
*G03G 15/00* (2006.01)
*G03G 21/00* (2006.01)

(52) U.S. Cl. ..... 399/159; 399/354

(58) Field of Classification Search ..... 399/159, 399/353, 354

See application file for complete search history.

(56) References Cited

U.S. PATENT DOCUMENTS

| | | | | |
|---|---|---|---|---|
| 5,147,751 | A | 9/1992 | Kojima et al. | |
| 7,226,711 | B2 * | 6/2007 | Amamiya et al. | 430/58.7 |
| 7,267,916 | B2 | 9/2007 | Sugino et al. | |
| 7,729,634 | B2 | 6/2010 | Nakamori et al. | |
| 7,860,429 | B2 * | 12/2010 | Ishikawa et al. | 399/101 |
| 2009/0208246 | A1 | 8/2009 | Kami | |
| 2010/0067953 | A1 | 3/2010 | Nohsho et al. | |
| 2010/0119260 | A1 | 5/2010 | Egawa et al. | |

FOREIGN PATENT DOCUMENTS

| | | |
|---|---|---|
| JP | 2-150850 | 6/1990 |
| JP | 4-330482 | 11/1992 |
| JP | 6-130875 | 5/1994 |
| JP | 2005-17416 | 1/2005 |
| JP | 2005-92146 | 4/2005 |
| JP | 2006-251400 | 9/2006 |
| JP | 2006-267856 | 10/2006 |
| JP | 2007-72398 | 3/2007 |
| JP | 2008-116645 | 5/2008 |
| JP | 2009-36956 | 2/2009 |

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus including an image bearing member having a photosensitive layer and the surface including concave portions having a concave diameter of from 5 to 200 μm, an irradiation device that irradiates the surface of the image bearing member with light to form a latent electrostatic image thereon, a development device that develops the latent electrostatic image with a development agent containing toner to obtain a visualized image, a transfer device that transfers the visualized image to a transfer medium, a first cleaning brush to which a bias is applied with a polarity reverse to that of the toner remaining on the surface of the image bearing member after the visualized image is transferred, and a second cleaning brush to which a bias is applied with the same polarity as that of the toner remaining on the surface of the image bearing member.

7 Claims, 6 Drawing Sheets

IMAGE FORMING APPARATUS, IMAGE BEARING MEMBER, AND METHOD OF MANUFACTURING IMAGE BEARING MEMBER

BACKGROUND OF THE INVENTION

1. Field of the Invention

The present invention relates to an image forming apparatus having an electrostatic brush cleaning device.

2. Discussion of the Background

In an image forming apparatus employing electrophotography, un-transferred toner that remains on the surface of an image bearing member after a toner image is transferred therefrom is typically removed by a cleaning device. A cleaning device employing a blade system has been widely used because it demonstrates good cleaning performance with a simple structure in which toner is scraped from the surface of an image bearing member with the blade.

This blade system is successful in reducing occurrence of image flow (image blur) because the mechanical force of scraping the surface of an image bearing member is strong. However, the surface of an image bearing member is easily damaged or abraded by such a strong mechanical force.

Therefore, an electrostatic brush cleaning system using a magnetic brush or a fur brush has been studied as an alternative to the mechanical blade system to remove toner on the surface of an image bearing member using static electricity. In comparison with the blade cleaning system, the electrostatic brushing cleaning system has relatively high cleaning maintenance ability and is particularly advantageous for a high-speed machine.

An image forming apparatus employing an electrophotography system typically transfers toner on the surface of an image bearing member to a transfer medium such as recording medium by applying a bias having a polarity reverse to the regular polarity of the toner attached to the surface of the image bearing member in the transfer process. Therefore, the toner remaining on the surface of the image bearing member after the transfer process includes both toner regularly charged and toner reversely charged. Therefore, when the electrostatic cleaning system is employed, a mechanism that electrostatically retrieves regularly charged toner and reversely charged toner is suitable.

Unexamined published Japanese patent application publication No. (hereinafter referred to as JP-A) H04-330482 describes a technology of using a cleaning device having a first cleaning brush that is positively charged to electrostatically attract negatively charged toner on the surface of the image bearing member and a second cleaning brush that is negatively charged to electrostatically attract positively charged toner on the surface of the image bearing member.

In this technology, the un-transferred toner remaining on the surface of the image bearing member after the transfer process is sufficiently removed by the structure having the first cleaning brush charged with a polarity reverse to that of the toner and the second cleaning brush charged with the same polarity as that of the toner. Therefore, when there is only one cleaning brush or multiple cleaning brushes all of which are charged with the same polarity, the un-transferred toner remaining on the surface of the image bearing member having either one of the regular polarity or the reverse polarity is not substantially removed, which results in deterioration of the image quality.

However, this electrostatic brush cleaning system having such a structure has a relatively low mechanical force to scrape toner off from the surface of the image bearing member in comparison with the mechanical blade cleaning system. Therefore, for example, corona products produced by a charging device are not sufficiently removed, which easily causes image flow (image blur). In addition, once an object (i.e., image bearing member) to be cleaned is scarred (or damaged), the brush cleaning system is known to have a tendency to repetitively trace the scar or damage with its brush fiber.

Therefore, the scar or damage on the image bearing member forms a deep streaky groove, which easily leads to production of abnormal halftone images with white streaks.

To deal with this, JP 2005-17416-A describes an image forming apparatus employing a two-brush system in which one of the cleaning brushes situated on the upstream side relative to the rotation direction of the image bearing member and the other cleaning brush situated on the downstream side relative to the rotation direction of the image bearing member are brought into contact with the image bearing member such that the edge force per filament of the brush of the cleaning brush on the upstream side is greater than that of the cleaning brush on the downstream side.

In addition, JP 2006-251400-A describes an image formation method in which two cleaning brushes are arranged along the rotation direction of the image bearing member and the toner contains complex particles in which inorganic particulates are dispersed and contained in resin particles. In addition, JP 2009-36956-A describes an image forming apparatus in which the cleaning brush (brush 2) situated on the downstream side relative to the rotation direction of the image bearing member is formed of a more rigid material than that forming the cleaning brush (brush 1) situated on the upstream side relative to the rotation direction of the image bearing member, and the brush 2 has a stronger mechanical scraping force than the brush 1.

However, in all of the image forming apparatuses and the image formation methods described above, the brush filaments still damage or scar the surface of the image bearing member, and thus abnormal half tone images having white streaks are easily produced.

SUMMARY OF THE INVENTION

For these reasons, the present inventors recognize that a need exists for an image forming apparatus having an electroconductive brush cleaning system having at least two electroconductive brushes that produces quality images over an extended period of time without producing abnormal images with a streaky uneven density caused by repetitive tracing of the same scar or damage by tips (filaments) of the brushes.

Accordingly, an object of the present invention is to provide an image forming apparatus having an electroconductive brush cleaning system having at least two electroconductive brushes that produces quality images over an extended period of time without producing abnormal images with a streaky uneven density caused by repetitive tracing on the same scar or damage by tips of the brushes.

Briefly, this object and other objects of the present invention as hereinafter described will become more readily apparent and can be attained, either individually or in combination thereof, by an image forming apparatus including an image bearing member having a photosensitive layer and the surface including concave portions having a concave diameter of from 5 to 200 μm, an irradiation device that irradiates the surface of the image bearing member with light to form a latent electrostatic image thereon, a development device that develops the latent electrostatic image with a development agent containing toner to obtain a visualized image, a transfer device that transfers the visualized image to a transfer medium, a first cleaning brush to which a bias is applied with a polarity reverse to that of the toner remaining on the surface of the image bearing member after the visualized image is transferred, and a second cleaning brush to which a bias is applied with the same polarity as that of the toner remaining on the surface of the image bearing member.

It is preferable that, in the image forming apparatus mentioned above, the surface of the image bearing member has an Rz of from 1 to 4 μm according to JIS B0601 under conditions of a tip of a sensing pin having a radius of 5 μm, a reference length L of 0.8 mm and an evaluation length 5L of 4 mm.

It is still further preferable that, in the image forming apparatus mentioned above, the concave portions have a diameter along the axis of the image bearing member greater than a diameter of fibers of the first cleaning brush and the second cleaning brush.

It is still further preferable that, in the image forming apparatus mentioned above, the concave portions are formed on the surface of the image bearing member by colliding particles from the side of the surface of the photosensitive layer after the photosensitive layer is formed.

As another aspect of the present invention, an image bearing member is provided which includes a substrate and a photosensitive layer having a surface having concave portions having a concave diameter of from 5 to 200 μm.

As another aspect of the present invention, a method of forming an image bearing member is provided which includes forming a photosensitive layer and then forming concave portions on the surface of the image bearing member by colliding particles with the surface of the photosensitive layer, the concave portions having a concave diameter of from 5 to 200 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention is described in detail below with reference to the accompanying drawings.

The present inventors have made an intensive study on the cause of the streaky uneven density which significantly degrades the image quality in the electrostatic cleaning system using at least two electrostatic cleaning brushes.

As a result of the study, it is found that, in a system of the electrostatic brush cleaning without using a blade, once minute damage (scar) occurs to the surface of an image bearing member in the rotation direction thereof, the tips of the brush arranged close to the scar trace every time the image bearing member rotates, thereby deepening the scar in the rotation direction. To avoid this phenomenon, based on various kinds of studies made with regard to the materials of the brush, the rotation speed of the brush, etc. the inventors have reached the conclusion that concave treatment to the surface of an image bearing member is effective.

Thinkable reasons are as follows.

In the electrostatic brush cleaning method without using a blade, once minute damage (scar) occurs to the surface of an image bearing member in the rotation direction thereof, the tips of the brush arranged close to the scar trace every time the image bearing member rotates. However, when myriad of concaves deeper than the minute scar are formed on the surface of an image bearing member and the tips of the brush trace the concaves, the tips of the brush are not controlled by the concaves and away from them to be back in the position that should be abraded since the concaves have no scars. Therefore, the scar does not grow in the depth direction.

According to the image forming apparatus of the present invention, since the cleaning brush fiber does not trace the same streak-like scar repeatedly due to the concave portions formed on the surface of an image bearing member, the growth of the streaky scar is limited.

Consequently, production of abnormal half tone images having white streaks caused by streaky scars having a depth of 3 μm or more is reduced.

In addition, unnecessary toner remaining on the surface of the image bearing member after the transfer process is sufficiently removed by the structure having a first cleaning brush charged with a polarity reverse to that of the toner and a second cleaning brush charged with the same polarity as that of the toner and thus the image forming apparatus of the present invention is capable of producing quality images for an extended period of time. Furthermore, the image bearing member is not abraded in a streak manner but uniformly, resulting in prolonging the working life of the image bearing member.

Figure 1:
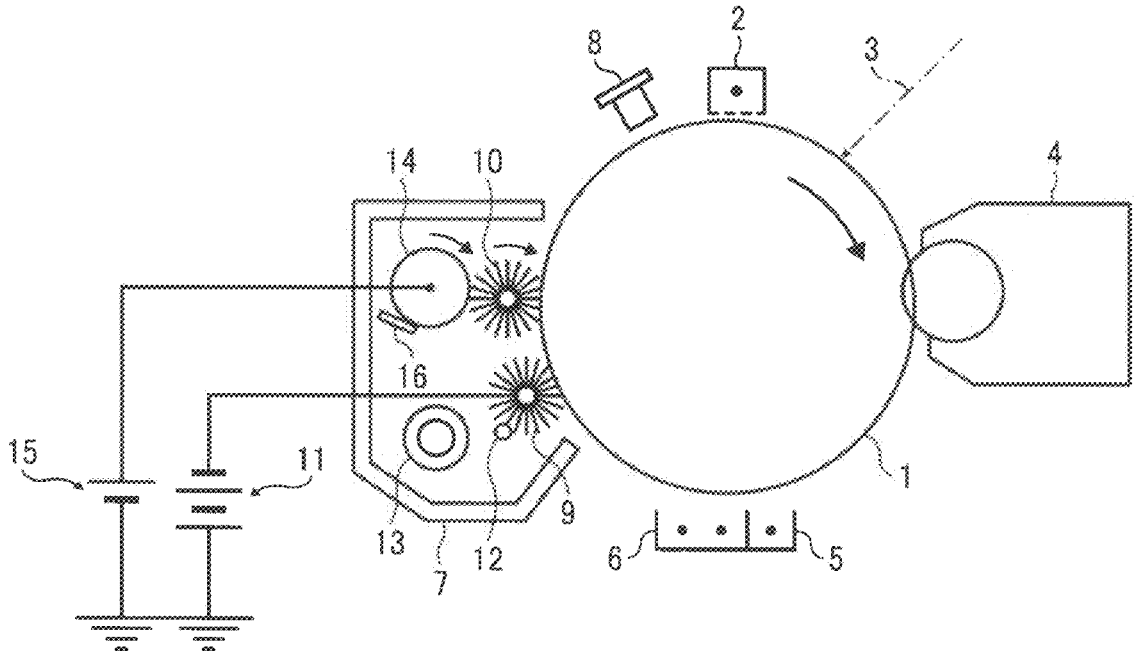
FIG. 1 is a schematic diagram illustrating an example of the image forming apparatus of the present invention.

FIG. 1 is a diagram illustrating an example of the image forming apparatus of the present invention having two electroconductive brush cleaning devices.

A photoreceptor drum 1 is charged by a charging device 2 rotationally driven by a main motor and then irradiated with image irradiation beams of light 3 emitted by a writing device to form a latent electrostatic image thereon followed by development of the latent electrostatic image with a development agent containing toner by a development device 4 to obtain a toner image.

A development bias is applied to the development device 4 by a development bias power source to develop the latent electrostatic image on the photoreceptor drum 1 with a toner having a small particle diameter.

The toner image on the photoreceptor drum 1 is transferred to a transfer medium conveyed from a paper feeder by a transfer charger 5. The transfer medium is separated from the photoreceptor drum 1 by a separation charger 6 and fixed at a fixing device to fix a toner image. In addition, after the transfer medium is separated from the photoreceptor drum 1, the surface of the photoreceptor drum 1 is cleared of the toner remaining thereon by a brush cleaning device 7 and discharged by a discharging device 8 to be ready for the next image formation cycle.

In FIG. 1, the brush cleaning device 7 has a first cleaning brush 9 charged with a polarity reverse to that of the toner and a second cleaning brush 10 charged with the same polarity as that of the toner. The first cleaning brush 9 is brought into contact with the photoreceptor drum 1 on the upstream side of the second cleaning brush 10 relative to the rotation direction of the image bearing member. A power source 11 applies a constant direct voltage to the first cleaning brush 9 to remove the toner remaining on the photoreceptor drum 1.

Reference numerals 12, 13, 14, 15, and 16 in FIG. 1 represent a flicking member, a toner discharging auger, a bias roller, a bias power source, and a blade, respectively.

The image bearing member related to the present invention represents an intermediate transfer body and an electrophotographic photoreceptor (photoconductor). A combination of the electrophotographic photoreceptor and a cleaning device is particularly suitable to reduce production of streaky density uneven images.

Figure 2:
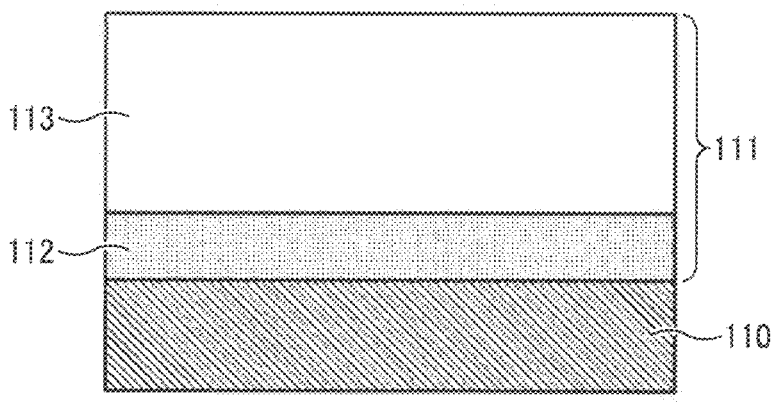
FIG. 2 is a cross section illustrating an example of the image bearing member of the present invention.

When the electrophotographic photoreceptor for use in the present invention is an organic photoconductor as illustrated in FIG. 2, an organic photosensitive layer 111 is accumulated on an electroconductive substrate (support) 110 and the photosensitive layer 111 is preferably a functionally separated laminate type photosensitive layer formed of a charge generation layer 112 and a charge transport layer 113.

Any known product can be used as the electroconductive substrate 110 such as drum-like or sheet-like molded metal to which metal or electroconductive material such as aluminum, alloy thereof, stainless steel, or an electroconductive material is applied with an optional suitable binder resin. Electroconductive-treated plastic, paper etc. having a sheet or drum form can be also used.

The charge generation layer 112 can be formed by dispersing a charge generation material such as azo pigments, quinone pigments, quinocyanine pigments, perylene pigments, indigo pigments, or phthalocyanine pigments in a binder resin such as polyvinyl butyral, polystyrene, acrylic resin, polyester, polyvinyl acetate, or polycarbonate. In addition, the charge generation layer 112 can be formed as a vacuum deposition film by a vacuum deposition device. The charge generation layer 112 preferably has a thickness of from 0.1 to 3 μm.

The charge transport layer 113 can be formed by dispersing a charge transport material such as styryl-based compounds, hydrazone-based compounds, triaryl amine-based compounds, carbazole-based compounds, oxazole-based compounds, or pyrazoline-based compounds in a binder resin such as polyarylate, polystyrene, acrylic resin, polyester, or polycarbonate. The charge transport layer 113 preferably has a thickness of from 10 to 40 μm. In addition, the photosensitive layer 111 may have a structure in which the charge generation layer 112 is formed on the charge transport layer 113 and can be of a single layer structure in which the charge generation materials specified above and the charge transport materials specified above are contained in a single layer.

Furthermore, an intermediate layer such as an undercoating layer can be provided between the electroconductive substrate 110 and the photosensitive layer 111 to improve the attachability and barrier property. In addition, a protection layer is suitably formed as the uppermost layer to secure abrasion resistance.

The image bearing member having a concave surface can be prepared by a method of roughening the surface by collision of particles. With regard to the method of roughening the surface by collision of particles, a method of forming concave portions on the surface of the image bearing member without destroying the surface is effective in comparison with other methods. From this point of view, a dry blasting method and a wet honing method are preferable. Among these, the dry blasting method is more preferable because a target object sensitive to the humidity condition can be roughened without a contact with a solvent such as water.

Blasting methods include a method of spraying compressed air and a method of spraying air using a motor as a driving force. The method of spraying compressed air is preferable in terms that roughening a target object can be accurately controlled and the facility is easy and simple.

Specific examples of the materials of abrasive particles for use in the blasting method include, but are not limited to, ceramics such as aluminum oxide, zirconia, silicon carbide, and glass, metals such as stainless steel, iron, and zinc, and resins such as polyamide, polycarbonate, epoxy, and polyester.

Among these, glass, aluminum oxide, and zirconia are preferable in terms of efficiency of roughening, and cost.

Figure 3:
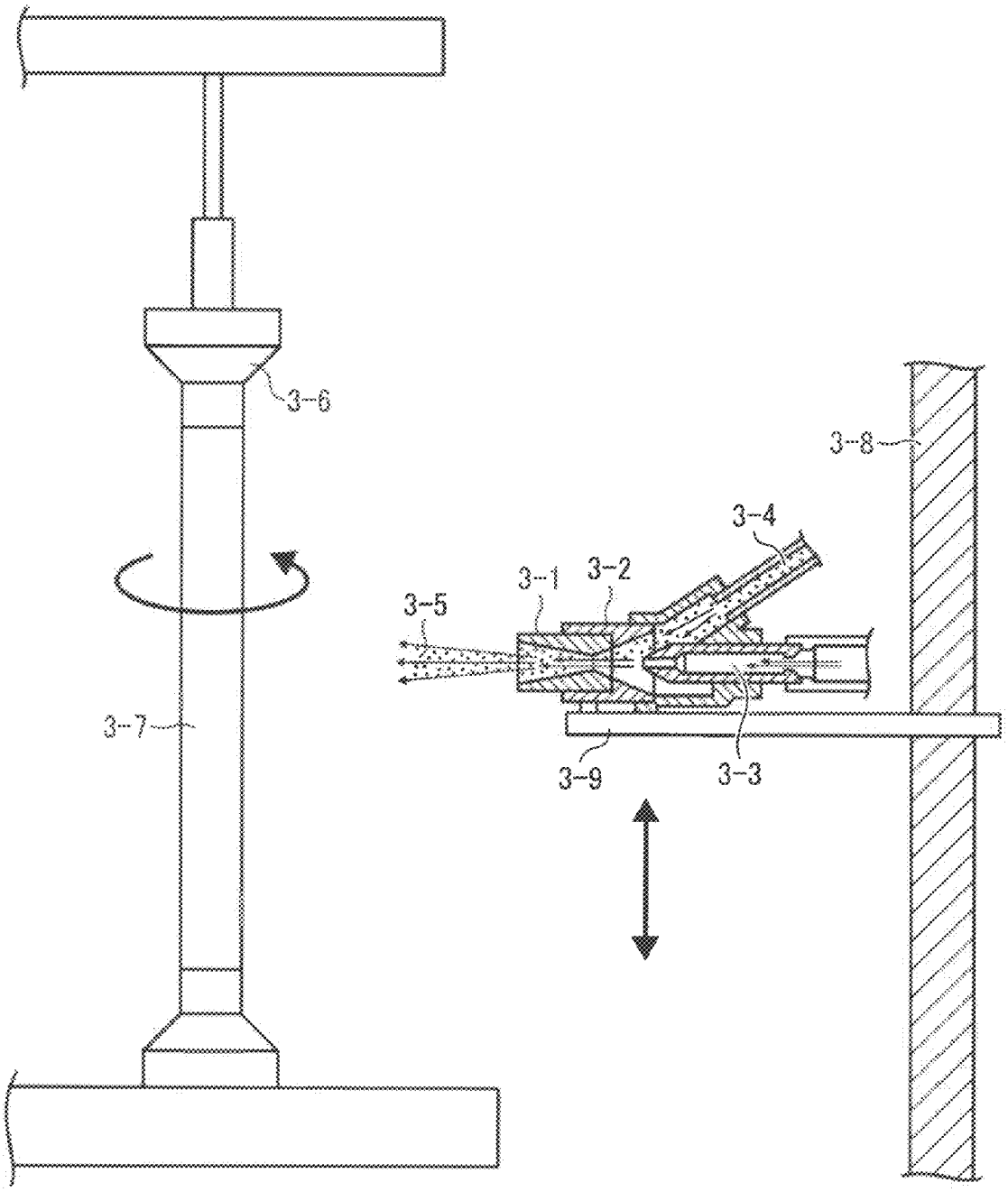
FIG. 3 is a schematic diagram illustrating an example of the blast processing device to roughen the surface of an image bearing member.

FIG. 3 is a diagram illustrating an example of the blast treatment device for use in the present invention.

Abrasive particles (blasting abrasive grain) 3-5 retained in a vessel (not shown) are guided from a passage 3-4 to a nozzle, sprayed from a spray nozzle 3-1 by using compressed air introduced from a passage 3-3, and collided with a target 3-7 in rotation supported by a work support 3-6.

The distance between the nozzle and the work is adjusted by a nozzle fixing jig 3-2 and an arm 3-9.

Typically, the nozzle sprays compressed air while moving relative to the rotation axis of the work. A nozzle support 3-8 moves along the rotation direction of the work so as to conduct roughening treatment to the work evenly.

The shortest distance between the nozzle and the surface of the target is adjusted to be suitable.

When the distance is too close, or remote, the processing efficiency tends to be worse or resultant roughening may not be desirable.

The pressure of the compressed air used as the driving force of spraying is also adjusted to be suitable.

A productive method can be established by roughening the surface of a target after a film is formed thereon.

In the method of forming concave portions on the surface of the image bearing member related to the present invention, an even roughness state in a range of from 0.5 to 5.0 μm can be formed. This roughness is measured according to the measuring method (point of sensing pin having a radius of 5 μm, reference length L=0.8 mm, evaluation length 5L=4 mm) of 10-point average roughness (Rz) defined in JIS B0601.

Taking into account the objective of the present invention, the range of the roughness is preferably from 1 to 4 μm according to 10-point average roughness (Rz). A long as this range is satisfied, production of abnormal images having streaky uneven density is reduced.

The concave portions in the present invention are a surface texture (form) prepared by colliding particles with the surface of the photosensitive layer after it is formed. The concave portions preferably have a diameter of from 5 to 200 μm, a depth of from 0.3 to 5 μm, and a concavity density of from 100 to 2,000,000 concavities/$cm^2$.

When the concave diameter is too small, the concave depth is too shallow, and the density of the number of concavities per area is too small, the force to control the scraping position of a brush tends to be insufficient, thereby causing scraping (abrasion) of the photosensitive layer, resulting in streaks.

To the contrary, when the concave diameter is too large, the concave depth is too deep, and the density of the number of concavities per area is too large, the force to control the scraping position of a brush tends to be sufficient, but scraping (abrasion) margin of the image bearing member tends to decrease. This is disadvantageous in light of prolonging the working life of an image bearing member and improvement of the reliability of the image bearing member using the system of two electrostatic cleaning brushes.

In addition, the diameter of the concave portion along the axis of the image bearing member is preferably greater than the fiber diameter of the cleaning brush, thereby markedly reducing production of abnormal images having streaky uneven density is reduced.

The diameter of the concave portion along the axis of an image bearing member is defined as the distance between the two top points adjacent to each other in the profile curve when measuring Rz. The average of 10 measured points is calculated as the diameter of the concave portion.

Rz and the diameter of the concave portion of the surface of the image bearing member can be adjusted by the diameter of abrasive particles used when roughening the surface, the pressure of the compressed air used as the driving force of spraying the abrasive particles, etc.

Next, the cleaning device for use in the present invention is described.

The cleaning device for use in the present invention includes a first cleaning brush (first electroconductive brush) charged with a polarity reverse to that of toner and a second cleaning brush (second electroconductive brush) charged with the same polarity as that of the toner.

For example, the cleaning device includes the first electroconductive brush and the second electroconductive brush arranged along the rotation direction of a (latent) image bearing member. A bias reverse to that of toner is applied to the first electroconductive brush and a bias having the same polarity as that of toner is applied to the second electroconductive brush when cleaning the image bearing member.

There is no specific limit to the arrangement of the first electroconductive brush and the second electroconductive brush. Arrangement sequence of the first electroconductive brush of the reverse polarity and the second electroconductive brush of the same polarity can be reversed (i.e., arrangement sequence of the second electroconductive brush of the same polarity and the first electroconductive brush of the reverse polarity).

There is no specific limit to the rotation direction of the first electroconductive brush and the second electroconductive brush. Both brushes are allowed to rotate against or along the rotation direction of the image bearing member while in contact with it.

The rotation direction of the brushes should be determined considering the force of scraping the toner. In light of the extension of the working life of an image bearing member, the rotation direction along the rotation direction of the image bearing member is preferable because it poses less of a burden on the image bearing member. Also, with regard to the difference between the peripheral speeds of the cleaning brush and that of the image bearing member, the smaller the better.

Typically, one pair (two brushes) of the first electroconductive brush and the second electroconductive brush is used. Two or more brushes can be independently used for the first and the second brushes.

For example, four brushes can be arranged in the sequence of the first electroconductive brush, the second electroconductive brush, the first electroconductive brush, and the second electroconductive brush, or the first electroconductive brush, the first electroconductive brush, the second electroconductive brush, and the second electroconductive brush.

In addition, as long as at least one pair of the first electroconductive brush and the second electroconductive brush is provided, the number of the first electroconductive brushes is not necessarily the same as that of the second electroconductive brushes.

From this point forward, the description is based on one pair (i.e., two brushes) of the first electroconductive brush and second electroconductive brush and the first electroconductive brush is arranged on the upstream side of the second relative to the rotation direction of the image bearing member.

Figure 4:
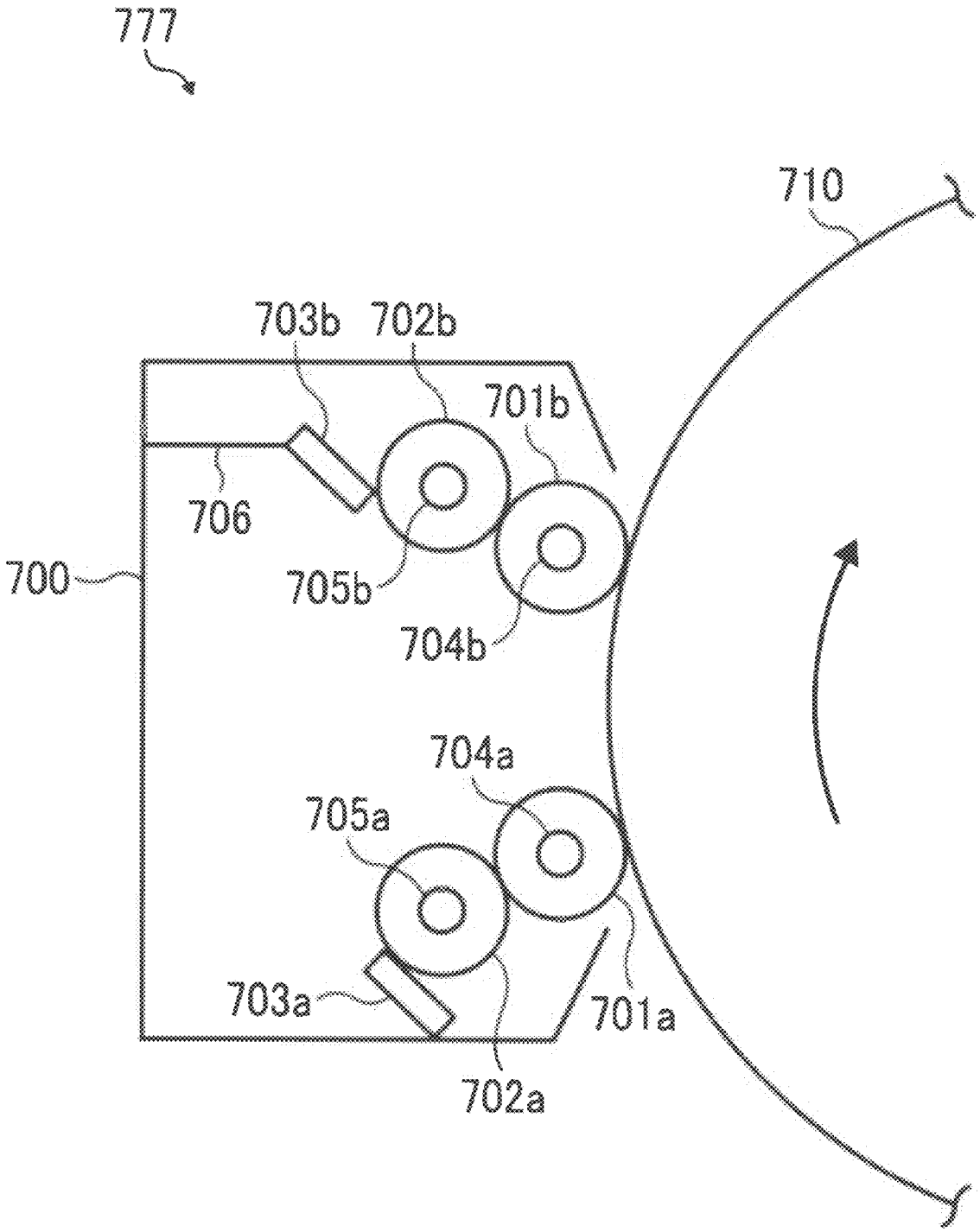
FIG. 4 is a schematic diagram illustrating an example of a cleaning device for use in the image forming apparatus of the present invention.

FIG. 4 is a schematic diagram illustrating an example of cleaning device for use in the present invention;

A cleaning device 777 illustrated in FIG. 4 employs a process cartridge system with two cleaning units.

That is, in FIG. 4, a first cleaning unit formed of a roll-like brush member (first electroconductive brush) 701*a*, a collection roll member 702*a*, and a scraper 703*a*, and a second cleaning unit formed of a roll-like brush member (second electroconductive brush) 701*b*, a collection roll member 702*b*, and a scraper 703*b* are contained in a housing 700. Instead of the collection roll members 702*a* and 702*b*, a flicking member that mechanically knocks off toner attached to the roll like brush members 701*a* and 701*b* can be also provided.

The housing 700 has an opening on the side closer to an image bearing member 710 and the periphery surface (where a phase is formed by the tip of the brushes) of the brush of the roll like brush members 701*a* and 701*b* is each in contact with the periphery of the image bearing member 710 through the opening.

The roll like brush member 701*a* (or 701*b*) is formed to have a roll-like form by arranging multiple fibers on the periphery of a shaft 705*a* (or 705*b*) along the direction from its center toward the periphery. The shafts 705*a* and 705*b* are arranged in parallel with a tangent of the image bearing member 710 and the roll like brush members 701*a* and 701*b* are rotatable around the shafts 705*a* and 705*b*. In addition, the distance between the image bearing member 710 and the shaft 705*a* or the shaft 705*b* is adjusted such that the biting amount of the tip of the roll like brush members 701*a* or 701*b* into the image bearing member 710 is set to be a particular value (preferably from 0.5 to 2.0 mm, and more preferably from 0.9 to 1.8 mm).

Specific examples of the fibers for use in the roll-like brush members 701*a* and 701*b* include, but are not limed to, resin fibers such nylon, acryl, polyolefin, and polyester. Any market products are available such as Beltron (manufactured by Kanebo), SA-7 (Toray Corporation), and UU nylon (manufactured by Unitika Limited).

These fibers preferably have a thickness of 30 denier or less (the diameter is 28 μm or less when the fiber has a specific gravity of 1.2 g/$cm^3$), more preferably (the diameter is 28 μm or less), 20 denier or less, and more particularly preferably, 0.5 to 10 denier (5 to 9 μm). The density of the fiber is preferably 20,000 fiber/inch$^2$ or more, and more preferably 40,000 fibers/inch$^2$ or more.

A method of blending electroconductive powder or an ion electroconductive material with fiber, or a method of forming an electroconductive layer inside or outside fiber, can be used to impart electroconductivity to the fiber of the roll-like brush member.

In addition, the resistance of the fiber to which electroconductivity is imparted is preferably from $10^2$ to $10^9$ Ωcm.

The collection roll members 702*a* and 702*b* are molded by curing a thermocuring resin and arranged on the periphery of the shaft 705*a* and 705*b*.

The periphery of the collection roll member 702*a* (or 702*b*) is in contact with the tip of the brush of the roll-like brush member 701*a* (or 701*b*).

In addition, the shaft 705*a* (or 705*b*) is arranged in parallel with the shaft 704*a* (or 704*b*) and the collection roll member 702*a* (or 702*b*) is rotatable around the shaft 705*a* (or 705*b*) functioning as the rotation axis.

Specific examples of the thermocuring resin for use in the collection roll members 702*a* and 702*b* include, but are not limited to, phenol resins, urea resin, melamine resins, unsaturated polyesters, epoxy resins, and polyimide resins.

Among these, phenol resins are preferable in terms of advantages such as dimension accuracy, easiness to mold, surface smoothness of molded body, and inexpensiveness.

The collection roll members 702*a* and 702*b* have a bending elastic modulus of 700 kPa or more.

When the bending elastic modulus is too small, the collection roll member tends to be flexible, which has affects on the contact position between the collection roll member and the brush member or the blade member, and the biting amount. To the contrary, when a collection roll member is formed by a material having an excessively small bending elastic modulus and has an increased thickness to maintain the rigidity, the molding shrinking tends to increase, which has an adverse impact on dimension accuracy. Furthermore, such a collection roll member involves problems such that the weight increases, molding time is elongated, and a post-processing is required. These problems lead to cost increase.

The bending elastic modulus is based on JIS K7203.

In addition, since the collection roll members 702*a* and 702*b* are in contact with the roll-like brush members 701*a* and 701*b*, and the scrapers 703*a* and 703*b*, respectively, the periphery of the collection roll members 702*a* and 702*b* can be abraded by their behavior.

In the present invention, when the amount of abrasion of the periphery of the collection roll members is measured according to JIS K6902, the abrasion amount is preferably 20 mg or less.

Therefore, the contact pressure with the brush member or the blade member and the biting amount can be set to have a great value, thereby stabilizing cleaning performance for an extended period of time.

A collection roll member that has an excessively large abrasion amount tends to have a short working life length, resulting in frequent replacement of the roll member.

The collection roll members 702*a* and 702*b* preferably have a Rockwell Hardness (M scale) of 100 or higher.

When the Rockwell hardness is in this range, molding having a high dimension accuracy can be conducted. In addition, the resultant roll member is extremely strong for scraping.

The Rockwell Hardness is based on JIS K7203.

The scrapers 703*a* and 703*b* are formed of thin metal plate and the edge of one end of the scraper is arranged in contact with the periphery of the collection roll members 702*a* and 702*b*, respectively.

The other end of the scrapers 703*a* and 703*b* are fixed to the housing 700. There is no specific limit to the method of fixing the scrapers to the housing. For example, the scraper 703*b* can be fixed by mounting hardware or the scraper 703*a* is directly fixed to the housing 700 as illustrated in FIG. 4.

Stainless steel or phosphor bronze is preferable as the material for the scrapers 703*a* and 703*b* in terms of durability and cost.

The scrapers 703*a* and 703*b* preferably have a thickness of from 0.02 to 2 mm, and more preferably from 0.05 to 1 mm.

A blade member can be used instead of a scraper.

In the cleaning device 700 having the structure described above, the toner remaining on the image bearing member 710 is removed by the roll-like brush members 701*a* and 701*b* after transfer.

Then, the remaining toner is moved to the contact position with the collection roll members 702*a* and 702*b* by the rotation of the roll-like brush members 701*a* and 701*b*.

Therefore, the tips of the brush of the roll-like brush members 701*a* and 701*b* are repetitively refreshed for the cleaning process for the image bearing member 710 for the next time.

The remaining toner attached to the collection roll members 702*a* and 702*b* are moved to the contact position with the scrapers 703*a* and 703*b* by the rotation of the collection roll members 702*a* and 702*b* and removed by the scrapers 703*a* and 703*b*.

Therefore, the surface of the collection roll members 702*a* and 702*b* are repetitively refreshed and used for the refreshing process for the tips of the brush of the roll-like brush members 701*a* and 701*b* for the next time.

In the present invention, a bias is applied to each of the roll-like brush members 701*a* and 701*b* with a different polarity to electrostatically attract and remove the extraneous matter such as toner or paper dust on the image bearing member 710. A mechanism that applies a cleaning bias having a potential between the roll-like brush member 701*a* (or 701*b*) and the collection roll member 702*a* (or 702*b*) is preferable.

To be more specific, a particular bias is applied to the roll-like brush member 701*a* (or 701*b*) to cause the remaining toner on the image bearing member 710 to adhere to the roll-like brush member 701*a* (or 701*b*) by electrostatic attraction force. The remaining toner attached to the roll-like brush member 701*a* (or 701*b*) is caused to adhere to the collection roll member 702*a* (or 702*b*) by applying a bias to the collection roll member 702*a* (or 702*b*) greater in absolute value than the bias applied to the roll-like brush member 701*a* (or 701*b*) with the same polarity.

The potential in absolute value between the roll-like brush member and the collection roll member is preferably 100 v or greater, more preferably 200 V or greater, and furthermore preferably 650 V or greater.

The fiber of the brush member is required to be electroconductive to apply a bias to the roll-like brush member 701*a* (or 701*b*).

A method of blending electroconductive powder or an ion electroconductive material with fiber, or a method of forming an electroconductive layer inside or outside fiber, can be used to impart electroconductivity to the fiber of the brush member. In addition, the resistance of the fiber to which electroconductivity is imparted is preferably from $10^2$ to $10^{11}$ Ωcm. A method of filling an inorganic fillers and/or the organic fillers is suitable as the method of adjusting the electric resistance of the collection roll member 702*a* and 702*b*, Inorganic fillers and organic fillers are advantageously filled in the collection roll member to increase the rigidity of the collection roll member.

Specific examples of the inorganic fillers include, but are not limited to, powder or fiber of metal such as tin, iron, copper, and aluminum and glass fiber.

Specific examples of the organic fillers include, but are not limited to, carbon black, carbon powder, graphite, magnetic powder, metal oxides such as zinc oxide, tin oxide, and titanium oxide, metal sulfides such as copper sulfide, and zinc sulfide, hard ferrite or magnetite of strontium, barium, and rare earths, ferrite of copper, zinc, nickel and manganese, materials thereof the surface of which is suitably electroconductively treated, and a solid solution (complex metal oxide) of a metal oxide obtained by baking at a high temperature a material selected from oxides, hydroxides, carbonates, or metal compounds containing different metals such as copper, iron, manganese, nickel, zinc, cobalt, barium, aluminum, tin, lithium, magnesium, silicon, and phosphorus, and polyaniline.

The collection roll member 702*a* or 702*b* at a voltage of 500 V preferably has a resistance of from $1\times10^5$ to $1\times10^{10}$ Ωcm, and more preferably from $1\times10^6$ to $1\times10^8$ Ωcm.

When the resistance is too small, infusion of the charge to the collection roll member easily occurs, thereby reversing the polarity of minute powder such as toner and paper dust scraped by the brush member. Therefore, such powder is hardly attracted electrostatically.

To the contrary, when the resistance is too large, the charge tends to cause a (charge-up) phenomenon that the charge accumulates on the collection roll member, which makes it difficult to attract such powder electrostatically.

The cleaning device 777 illustrated in FIG. 4 includes two cleaning units having each of which has the roll-like brush member (701*a* or 701*b*), a collection roll member (702*a*, or 702*b*), and the scrapers (703*a* or 703*b*). The bias applied to the roll-like brush member is adjusted such that the two roll-like brush members have reverse polarity to each other.

Since only one cleaning unit is not enough to demonstrate good cleaning performance, one pair of the cleaning units is provided in this embodiment as described above. More cleaning units can be provided, if desired.

The polarity of the toner remaining on the image bearing member 710 after transfer varies depending on the transfer electric field. That is, most of the toner remaining on the image bearing member 710 is present having the same polarity as that of the toner supplied to the image bearing member 710 during development but the polarity of part of the remaining toner is reversed in some cases. In such cases, by making the polarity of the bias applied to the roll-like brush member 701*a* in the cleaning unit formed of the roll-like brush member 701*a*, the collection roll member 702*a* and the scraper 703*a* reverse to that applied to the roll-like brush member 701*b* in the cleaning unit formed of the roll-like brush member 701*b*, the collection roll member 702*b* and the scraper 703*b*, one of the cleaning units can be used to remove the remaining toner charged with a regular polarity, and the other can be used to remove the remaining toner charged with a reverse polarity. Therefore, the remaining toner can be efficiently removed regardless of the polarity of the remaining toner.

To be more specific, first, a bias having a reverse polarity is applied to the roll-like brush member 701*a* and the collection roll member 702*a* of the first cleaning unit to electrostatically attract and remove the toner charged with a regular polarity which occupies most of the remaining toner.

Then, a bias having a regular polarity is applied to the roll-like brush member 701*b* and the collection roll member 702*b* of the second cleaning unit to electrostatically attract and remove the toner charged with a reverse polarity.

The bias to be applied for the first cleaning unit preferably is from 0 to +1,500 V, and, for the second cleaning unit, from 0 to −1,500 V.

The image forming apparatus of the present invention includes a charging unit, a development device, a development agent, a transfer device, and a discharging device. Any known devices can be used.

Figure 5:
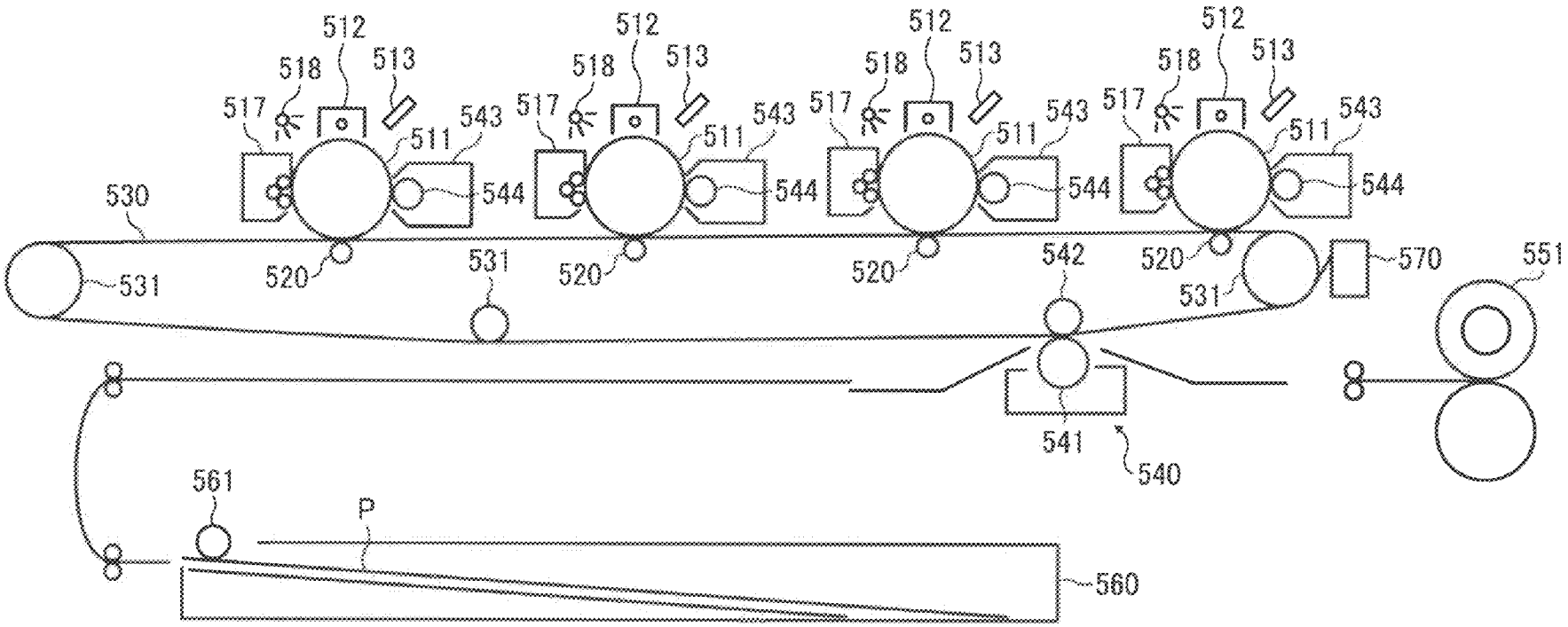
FIG. 5 is another schematic diagram illustrating an example of the image forming apparatus of the present invention.

The present invention is applicable to the image forming apparatus having an intermediate transfer body of a tandem arrangement as illustrated in FIG. 5.

In FIG. 5, reference numerals 511, 512, 513, 517, 518, 520, 530, 531, 540, 541, 542, 543, 544, 551, 560, 561, and 570 represent an image bearing member (photoreceptor), a charging device, a writing unit, a cleaning unit for the image bearing member, a light source for discharging, a primary transfer roller, an intermediate transfer belt, an intermediate transfer belt roller, a secondary transfer unit, a secondary transfer roller, a secondary transfer opposing roller, a development unit, a development roller, a registration roller, a duplex mode unit, a transfer roller for duplex mode, and an intermediate transfer belt cleaning unit, respectively.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is described in detail with reference to following Examples.

Example 1

A color photocopier employing a tandem arrangement (imagio MP C7500, manufactured by Ricoh Co., Ltd.) is remodeled by using the cleaning device illustrated in FIG. 4.

The cleaning device and the image bearing member (photoreceptor) of this remodeled photocopier is described below.

In the cleaning device, the first cleaning device described below is situated on the upstream side of the second cleaning unit relative to the rotation direction of the photoreceptor.

First Cleaning Unit (1) Roll-Like Brush Member

Brush material: electroconductive nylon

Fiber thickness: about 40 μm

Resistance: 1×105Ω

Length of brush: 4 mm

Fiber density: 50,000 fibers per inch2
Biting amount to photoreceptor: about 1.0 mm
Peripheral speed: 60 mm/s

| | |
|---|---|
| Bisazo pigment represented by the following chemical structure | 9 parts |

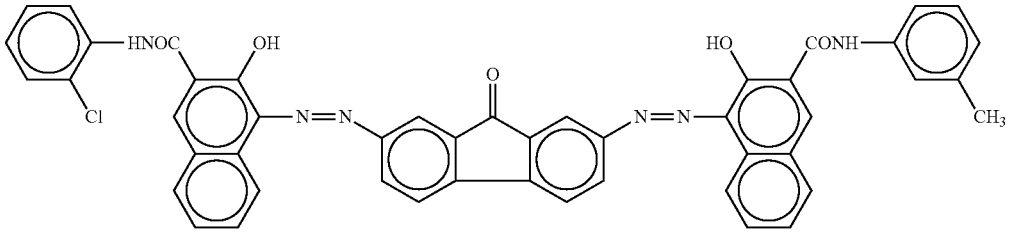

| | |
|---|---|
| Polyvinyl butyral {XYHL, manufactured by Union Carbide Corporation (UCC)} | 0.5 parts |
| Cyclohexanone | 200 parts |
| Methylethyl ketone | 80 parts |

Rotation direction: against the rotation direction of the photoreceptor
Bias applied to brush: +200 V
Second Cleaning Unit
(1) Roll-Like Brush Member
Brush material: electroconductive nylon
Fiber thickness: about 40 μm
Resistance: 1×105Ω
Length of brush: 4 mm
Fiber density: 50,000 fibers per inch2
Biting amount to photoreceptor: about 1.0 mm
Peripheral speed: 60 mm/s
Rotation direction: against the rotation direction of the photoreceptor
Bias applied to brush: −400 V
Image Bearing Member (Photoreceptor)

The liquid application of undercoating layer, the liquid application of a charge generation layer, and the liquid application of a charge transport layer, each of which has the following recipe are applied to an aluminum cylinder having an outer diameter of 60 mm, in that order, by a dip coating method followed by drying to obtain an undercoating layer having a thickness of about 3.5 μm, a charge generation layer having a thickness of about 0.2 μm, and a charge transport layer having a thickness of about 28 μm.

Liquid Application of Undercoating Layer

| | |
|---|---|
| Alkyd resin (Beckozole 1307-60-EL, manufactured by Dainippon Ink and Chemicals, Inc.) | 6 parts |
| Melamine resin (Super-beckamine G-821-60, manufactured by Dainippon Ink and Chemicals, Inc.) | 4 parts |
| Titanium oxide (CR-EL, manufactured by Ishihara Sangyo Kaisha, Ltd.) | 40 parts |
| Methylethyl ketone | 50 parts |

Liquid Application of Charge Generation Layer

A solution of bisazo pigment and methylethyl ketone having a 10% solid portion according to the following recipe is dispersed by a ball mill using zirconia balls for 10 days.

Cyclohexanone is added to the liquid dispersion to obtain a pigment dispersion liquid having a 3% solid portion, followed by two-hour ball mill dispersion.

This pigment liquid dispersion is added to a solution mixture containing the rest of the materials. Subsequent to stirring, the solution is filtered with stainless meshes having 1,000 meshes to prepare the liquid application of the charge generation layer.

Liquid Application of Charge Transport Layer

| | |
|---|---|
| Bisphenol Z type polycarbonate (Panlite TS-2050, manufactured by Teijin Chemicals Limited) | 10 parts |
| Charge transport material represented by the following structure | 7 parts |

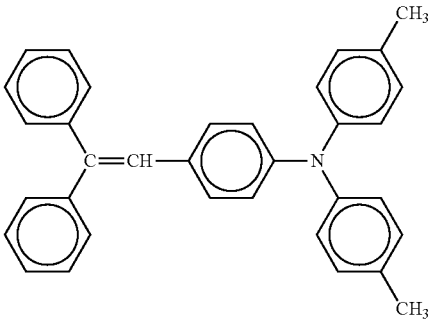

| | |
|---|---|
| Tetrahydrofuran | 100 parts |
| Tetrahydrofuran solution of 1% silicone oil (KF-50-100CS, manufactured by Shin-Etsu Chemical Co., Ltd. | 1 part |

Concave Portion Formation Treatment

The thus obtained photoreceptor is subject to concave portion formation treatment on the uppermost surface layer.

The resultant is subject to blast treatment under the following conditions by using a dry blast device (Fuji Seiki Co., Ltd.) illustrated in FIG. 3.

Spherical glass beads (particle diameter: 40 μm. manufactured by Asada Iron Works Co., Ltd.) are used as abrasive particles.

The pressure of the compressed air during the blasting treatment is 0.35 MPa, the moving speed of the spraying nozzle along the rotation direction is 380 mm/min, the rotation speed of the work (photoreceptor) is 60 rpm, the distance between the nozzle and the work (photoreceptor) is 80 mm, the spitting angle of the abrasive particles is 90 degree, the amount of supplying the abrasive particles is 150 g/min, the number of times of blasting is one way, twice, and the blasting treatment position is from 2.5 mm of the top edge of application to the other edge.

Rz of the surface of the obtained photoreceptors is 2.5 μm.

100,000 images are output by the image forming apparatus manufactured as described above under the following conditions. When a half tone image of 600 dpi and 2 by 2 is confirmed after the 100,000 images are output, the uniformity of the image density is as good as the same as that at printing at the initial stage.

Processing speed: 360 mm/s
Development system: two component reverse development system
Toner charging polarity: minus
Toner particle diameter: 6.5 μm
Charging bias: −600 V
Development bias: −450 V
Bias after irradiation: −100 V Comparative Example 1

Another image forming apparatus (of Comparative Example 1) is manufactured in the same manner as in Example 1 except that no concave portion is formed (Rz is 0.3 μm).

100,000 images are output by the image forming apparatus manufactured as described above under the following conditions. When a half tone image of 600 dpi and 2 by 2 is confirmed after the 100,000 images are output, the uniformity of the image density is bilaterally asymmetric and significantly bad with regard to streaky uneven density.

To study the cause of the bilateral asymmetry and streaky unevenness of the image density, the photoreceptor is removed out from the image forming apparatus to observe the status of the surface of the photoreceptor. Concave-form streaks occur significantly to the surface of the photoreceptor with a depth of from 4 to 6 μm, which is found to cause the bilateral asymmetry.

Examples 2 to 8

Image forming apparatuses are manufactured in the same manner as in Example 1 except for using photoreceptors manufactured under different conditions for forming concave portions {different concave depth (Rz)} followed by the photocopier test.

The concave formation conditions and RZ are shown in Table 1 and the results of the photocopier test are in Table 2.

TABLE 1

| | Concave portion formation conditions | | | Concave form | |
|---|---|---|---|---|---|
| | Media | Medium diameter (μm) | Air pressure (MPa) | Rz (μm) | Concave diameter (μm) |
| Example 1 | Glass beads | 400 | 0.35 | 2.5 | 62 |
| Example 2 | Glass beads | 400 | 0.15 | 0.6 | 31 |
| Example 3 | Glass beads | 400 | 0.23 | 1.3 | 49 |
| Example 4 | Glass beads | 400 | 0.65 | 3.8 | 75 |
| Example 5 | Glass beads | 400 | 0.80 | 6.0 | 106 |
| Example 6 | Glass beads | 1000 | 0.20 | 0.2 | 30 |
| Example 7 | Glass beads | 1000 | 0.50 | 2.7 | 114 |
| Example 8 | Glass beads | 1000 | 0.90 | 5.8 | 156 |

TABLE 1-continued

| | Concave portion formation conditions | | | Concave form | |
|---|---|---|---|---|---|
| | Media | Medium diameter (μm) | Air pressure (MPa) | Rz (μm) | Concave diameter (μm) |
| Comparative Example 1 | None | None | none | 0.3 | None |

Concave diameter is an average of 10 distances each of which is the distance between two adjacent points of the primary profile obtained when measuring Rz.

TABLE 2

| | Image after 100,000 images are output | | |
|---|---|---|---|
| | Bilateral asymmetry | Streaky image | Image at initial stage |
| Example 1 | None | None | — |
| Example 2 | Slightly observed | Slightly observed | — |
| Example 3 | None | None | — |
| Example 4 | None | None | — |
| Example 5 | None | None | Slightly contaminated |
| Example 6 | Slightly observed | Slightly observed | — |
| Example 7 | None | None | — |
| Example 8 | None | None | Slightly contaminated |
| Comparative Example 1 | Unevenness observed | Yes | — |

The image bearing members manufactured according to the concave formation method in Examples are studied with regard to Rz (from 0.2 to 6 μm), and the concave diameter (from 30 to 150 μm). As seen in Tables 1 and 2, production of images having streaks or occurrence of bilateral asymmetry are reduced in the case in which the photoreceptor has an Rz of from 1.3 to 3.8 μm and an concave diameter greater than the diameter of the brush fiber.

In addition, when Rz is too small, the effect tends to be hardly sustained and slight streaky density unevenness is observed in this test.

With regard to the concave diameter, in Examples 2 and 6 in which the concave diameter is smaller than the fiber diameter of the brush used, the brush is not controlled so that streaky density unevenness easily occurs since the brush does not intrude into the deep portion.

When the surface statuses are compared between Comparative Example 1 and Example 1 after 100,000 images are output, it is confirmed that streaky scar hardly occurs to the surface of the photoreceptor because of the concave portions.

Figure 6:
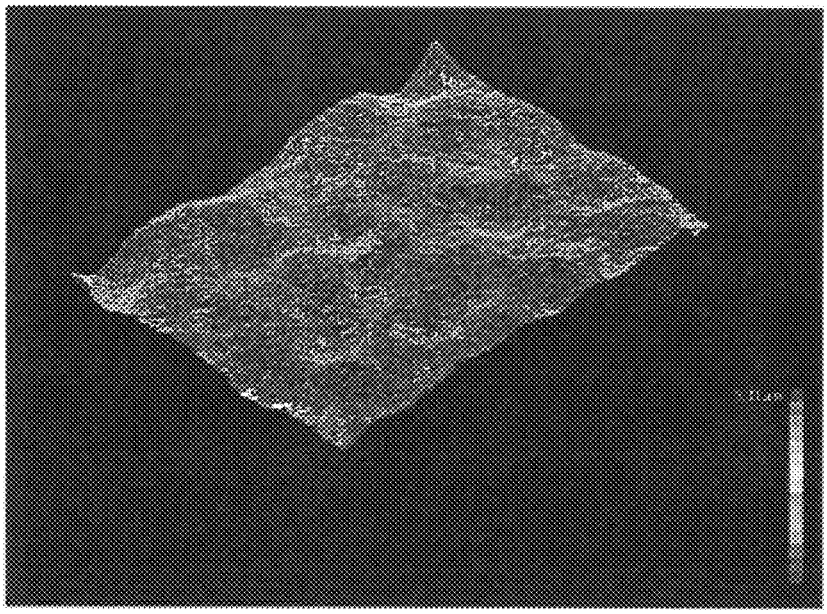
FIG. 6 is a 3D photograph illustrating the initial surface state of the image bearing member of Example 1 described later.
Figure 7:
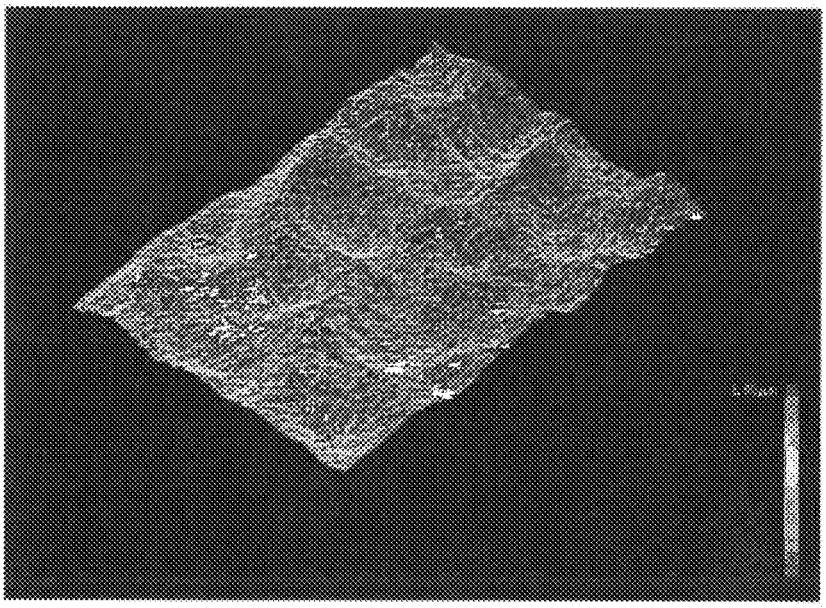
FIG. 7 is a 3D photograph illustrating the surface state of the image bearing member of Example 1 described later after 100,000 outputs.

FIGS. 6 and 7 are three dimensional photographs illustrating the status of the photoreceptor of Example 1 at the initial state and after the 100,000 image output test, respectively.

Figure 8:
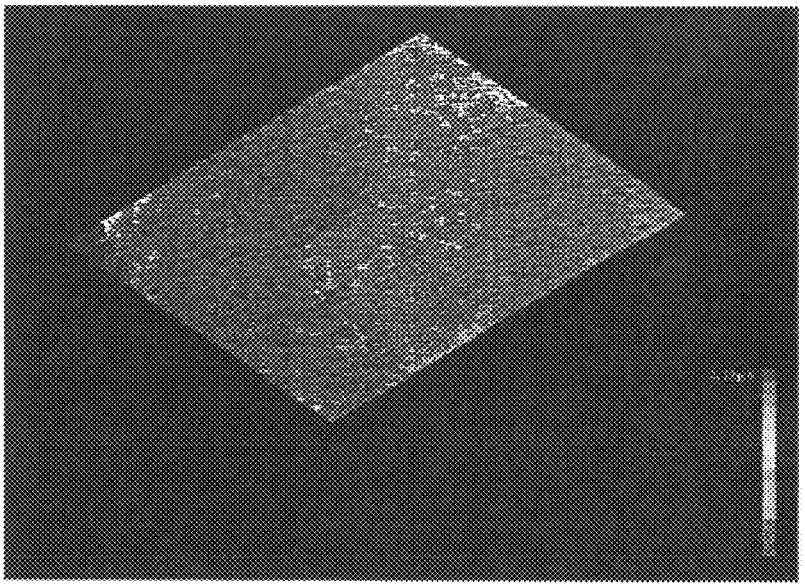
FIG. 8 is a diagram illustrating the initial surface state of the image bearing member of Comparative Example 1 described later.
Figure 9:
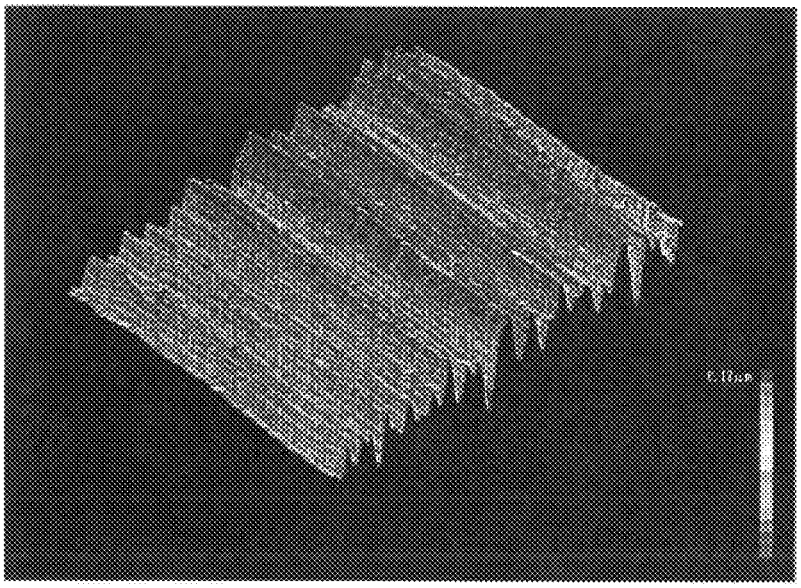
FIG. 9 is a 3D photograph illustrating the surface state of the image bearing member of Comparative Example 1 described later after 100,000 outputs.

FIGS. 8 and 9 are a diagram and a three dimensional photograph illustrating the status of the photoreceptor of Comparative Example 1 at the initial state and after the 100,000 image output test, respectively.

In FIGS. 6 to 9, the length along two o'clock direction represents 300 μm.

This document claims priority and contains subject matter related to Japanese Patent Application No. 2009-154791, filed on Jun. 30, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member comprising a photosensitive layer having a surface comprising concave portions having a concave diameter of from 5 to 200 μm;

an irradiation device that irradiates the surface of the image bearing member with light to form a latent electrostatic image thereon;

a development device that develops the latent electrostatic image with a development agent comprising toner to obtain a visualized image;

a transfer device that transfers the visualized image to a transfer medium;

a first cleaning brush to which a bias is applied with a polarity reverse to that of the toner remaining on the surface of the image bearing member after the visualized image is transferred; and a second cleaning brush to which a bias is applied with a same polarity as that of the toner remaining on the surface of the image bearing member.

2. The image forming apparatus according to claim 1, wherein the surface of the image bearing member has an Rz of from 1 to 4 μm according to JIS B0601 as measured with a tip of a sensing pin having a radius of 5 μm, a reference length L of 0.8 mm, and an evaluation length 5L of 4 mm.

3. The image forming apparatus according to claim 1, wherein the concave portions in the surface of the photosensitive layer of the image bearing member have a diameter along an axis of the image bearing member greater than a diameter of individual fibers of the first cleaning brush and the second cleaning brush.

4. The image forming apparatus according to claim 2, wherein the concave portions in the surface of the photosensitive layer of the image bearing member have a diameter along an axis of the image bearing member greater than a diameter of individual fibers of the first cleaning brush and the second cleaning brush.

5. The image forming apparatus according to claim 1, wherein the concave portions are formed on the surface of the image bearing member by colliding particles with the surface of the photosensitive layer after the photosensitive layer is formed.

6. The image forming apparatus according to claim 2, wherein the concave portions are formed on the surface of the image bearing member by colliding particles with the surface of the photosensitive layer after the photosensitive layer is formed.

7. The image forming apparatus according to claim 3, wherein the concave portions are formed on the surface of the image bearing member by colliding particles with the surface of the photosensitive layer after the photosensitive layer is formed.

* * * * *